US011286727B2

(12) United States Patent
Ahmed et al.

(10) Patent No.: US 11,286,727 B2
(45) Date of Patent: Mar. 29, 2022

(54) MULTIFUNCTION WELLBORE CONDITIONING TOOL

(71) Applicants: Shehab Ahmed, Houston, TX (US); Mohamed Al-Jahwari, Muscat (OM); Sena Dorvlo, Muscat (OM); Mohamed Abdelaal, Cairo (EG); MODUS QSTP-LLC, Doha (QA); MODUS QSTP-LLC GLOBAL PATENT TRUST, Alexandria, VA (US)

(72) Inventors: Shehab Ahmed, Houston, TX (US); Mohamed Al-Jahwari, Muscat (OM); Sena Dorvlo, Muscat (OM); Mohamed Abdelaal, Cairo (EG)

(73) Assignee: MODUS OILFIELD INTERNATIONAL LLC, Houston, TX (US)

( * ) Notice: Subject to any disclaimer, the term of this patent is extended or adjusted under 35 U.S.C. 154(b) by 226 days.

(21) Appl. No.: 16/461,731

(22) PCT Filed: Nov. 20, 2017

(86) PCT No.: PCT/US2017/062531
§ 371 (c)(1),
(2) Date: May 16, 2019

(87) PCT Pub. No.: WO2018/094318
PCT Pub. Date: May 24, 2018

(65) Prior Publication Data

US 2019/0360280 A1 Nov. 28, 2019

Related U.S. Application Data

(60) Provisional application No. 62/424,371, filed on Nov. 18, 2016.

(51) Int. Cl.
*E21B 17/10* (2006.01)
*E21B 10/30* (2006.01)
*E21B 10/32* (2006.01)

(52) U.S. Cl.
CPC ..... *E21B 17/1078* (2013.01); *E21B 10/30* (2013.01); *E21B 10/325* (2013.01)

(58) Field of Classification Search
CPC .... E21B 17/1078; E21B 10/30; E21B 10/325; E21B 10/26; E21B 17/00
See application file for complete search history.

(56) References Cited

U.S. PATENT DOCUMENTS 2,665,887 A * 1/1954 Shelton ..... E21B 31/107 175/295
3,916,998 A * 11/1975 Bass, Jr ..... E21B 17/1078 166/301

(Continued)

FOREIGN PATENT DOCUMENTS

GB 2356418 A 5/2001
WO 3004029402 A1 4/2004
WO 2016108854 A1 7/2016

*Primary Examiner* — Steven A MacDonald
(74) *Attorney, Agent, or Firm* — Nath, Goldberg & Meyer; Richard C. Litman

(57) ABSTRACT

The multifunction wellbore conditioning tool (100, 200, 300) is installed in the bottom hole assembly of a drill string and performs the functions of a cutting tool, keyseat wiper, roller reamer, keyseat wiper, and stabilizer during drilling operations, precluding the need for multiple different tools in the drill string. The tool (100, 200, 300) has a working sleeve (114, 214, 314) captured concentrically on the driveshaft (102, 202, 302) between opposed spring sets (134, 136; 234, 236; 334, 336). The sleeve (114, 214, 314) remains rotationally stationary about the rotating driveshaft (102, 202, 302) when in its central or neutral position on the driveshaft (102, 202, 302). When the sleeve (114, 214, 314) shifts axially on the driveshaft (102, 202, 302) it engages a clutch mechanism that allows it to rotate with the driveshaft (102, (Continued)

202, 302) so that the rotating working sleeve (114, 214, 314) conditions the borehole.

14 Claims, 16 Drawing Sheets

(56) References Cited

U.S. PATENT DOCUMENTS 4,105,262 A * 8/1978 Richey ..... E21B 17/1078 175/325.2
4,186,569 A 2/1980 Aumann
4,231,437 A 11/1980 Swersky et al.
4,877,092 A * 10/1989 Helm ..... E21B 7/068 175/74
5,048,606 A * 9/1991 Allwin ..... E21B 23/01 166/208
5,474,334 A * 12/1995 Eppink ..... E21B 7/067 175/74
6,279,962 B1 * 8/2001 McGarian ..... E21B 17/06 285/12
7,083,010 B2 8/2006 Eppink et al.
8,028,769 B2 10/2011 Pessier et al.
8,381,843 B1 * 2/2013 Lamontagne ..... E21B 10/26 175/295
2011/0265988 A1 11/2011 Hern et al.
2012/0132469 A1 5/2012 Robson et al.
2012/0279784 A1 11/2012 Harvey et al.
2013/0319769 A1 12/2013 Scott
2014/0131606 A1 * 5/2014 Smith, III ..... F16L 29/04 251/282
2014/0202770 A1 7/2014 Zaki et al.
2014/0246236 A1 9/2014 Radford et al.
2014/0251692 A1 * 9/2014 McKay ..... E21B 17/1078 175/57
2016/0138342 A1 5/2016 Svendsen et al.

* cited by examiner

MULTIFUNCTION WELLBORE CONDITIONING TOOL

TECHNICAL FIELD

The disclosure of the present patent application relates generally to earth drilling and well boring operations and equipment, and particularly to a multifunction wellbore conditioning tool operable as a cutting, reaming, keyseat wiping, friction reducing, and stabilizing device in a borehole.

BACKGROUND ART

Earth boring of oil, gas, and water wells has developed into a precision industry. Some boreholes are being made to follow precisely predetermined paths through the earth and are being precisely formed (conditioned) for the installation of casing to line the borehole, as well as to facilitate re-entry using open hole logging tools. This precision is accomplished by means of specialized tools and equipment installed with the bottom hole assembly, i.e., that portion of the drill string between the bit at the lowermost distal end up to the remainder of the drill string.

One commonly used bottom hole tool is the stabilizer, which is installed in the bottom hole assembly to reduce or preclude excessive lateral movement or oscillation of the drill string during drilling operations. Stabilizers are provided with diameters substantially equal to the diameter of the borehole, which is determined by the cutting diameter of the bit being used.

In some cases the borehole is undersize at certain points, i.e., has a diameter less than that desired for the installation of casing, etc. This may be caused by various factors, such as hard rock structures that intrude into the bore hole even after the bit has passed. Such intrusions are normally removed by the installation of a roller reamer in the bottom hole assembly, then positioning the reamer at the desired depth and operating the drill string to ream out the intrusion.

Such specialized earth boring tools as stabilizers and roller reamers are generally manufactured as single special purpose devices, and are not well suited for other than their specific purposes. Keyseat wipers (i.e., devices to widen a portion of a bore hole where the drill string has cut into the side of the passage to form a keyhole-shaped cross section), as well as fixed blade cutters, are also typically used in a drill string configuration to assist in wellbore conditioning. A keyseat wiper is used to remove keyseats that develop during the drilling process. Fixed blade cutters are also typically used when roller reamers alone cannot provide the needed wellbore conditioning. Friction reducers are also used in a bottom hole assembly to reduce torque resistance in deviated holes. They allow freer rotation of the drill string at the dog leg, which adds power to the bit, increases rate of penetration, and decreases fatigue of the drill string and rotary equipment. A typical drill string would require a combination of such tools to complete the drilling operation. Thus, a multifunction wellbore conditioning tool solving the aforementioned problems is desired.

DISCLOSURE OF INVENTION

The multifunction wellbore conditioning tool includes an assembly that is installed in the bottom hole assembly of the drill string to serve multiple functions, including use as a cutting tool, as well as a keyseat wiper, a reamer, a friction reducer, and a stabilizer, without the need to add, remove or replace different implements on the bottom hole assembly. The tool includes a central driveshaft that is rotationally fixed to the drill string above the tool and to the remainder of the bottom hole assembly between the tool and the bit. The driveshaft rotates in unison with the remainder of the drill string. A generally cylindrical working sleeve is installed concentrically about the driveshaft. The working sleeve may rotate or may remain rotationally stationary relative to the rotating driveshaft depending on borehole diameter at the working sleeve position. The shaft may shift axially relative to the working sleeve transmitting the axial load to the spring sets via the thrust transmitting system (a thrust carrying element disc/washers disposed on either the shaft or the cylindrical housing and a frictionless rotating surface) to engage the working sleeve by engaging the friction coupling sleeves or the housing and sleeve engagement ends at certain predetermined force amount and rotate therewith, thereby performing cutting and keyseat wiping operations, as well as stabilizing the drill string when the borehole diameter is substantially the same as that of the sleeve. Minor axial shifts prior to engagement with the shaft can result in reaming function for the tool. So, the cutting, keyseat wiping, and reaming functions each will take place at certain predetermined force value.

Three embodiments are disclosed herein. The first embodiment incorporates a mechanical engagement through a dog clutch at each end of the central working sleeve. The sleeve is normally free to rotate relative to the driveshaft, or to remain stationary relative to the rotating shaft, but will engage the dog clutch at either end thereof when translated axially along the shaft. Springs are installed at each end of the sleeve to hold the sleeve clear of the clutches unless some axial force causes the sleeve to move axially along the shaft. As an example, if the working sleeve hangs up as the drill string progresses through the borehole, at certain predetermined force value, the upper dog clutch component installed on the drill string will engage the mating component on the upper end of the working sleeve, thereby causing the sleeve to rotate in unison with the shaft to ream out the obstruction upon which it is caught, using the full drill string torque. Clutch engagement may be abrupt with this embodiment.

A second embodiment provides for a more gradual application of drill string torque to the working sleeve through a rotational lockup mechanism applied to the working sleeve with the driveshaft when the sleeve is shifted axially along the shaft. The function is the same as that of the first embodiment, i.e., to cause the sleeve to lock rotationally with the shaft when the sleeve shifts axially along the shaft. However, the mechanism used to accomplish this is different, and the component of the cutting force applied to the working sleeve is different and gradually increases to full drill string torque, as in the first embodiment. In the second embodiment, upper and lower intermediate cylinders are installed on the driveshaft between the shaft and the outer working sleeve. The intermediate cylinders are rotationally fixed to the driveshaft, and have a plurality of radially protruding square or rectangular teeth extending therefrom. The upper and lower portions of the working sleeve have a plurality of passages formed therein, each of the passages having a lug extending radially inward therefrom. The lugs can rotate relative to the working sleeve, due to the cylindrical shapes of the lugs and passages. The lugs have square heads that impinge upon the annular space between the cylinders and the outer sleeve, but remain clear of the teeth protruding from the cylinders when the working sleeve is in its neutral position along the driveshaft. If the sleeve catches on some protrusion in the borehole as the drill string and driveshaft continue to advance, the sleeve moves axially relative to the shaft and the two intermediate cylinders. When sufficient axial movement has occurred, the teeth of the intermediate cylinders engage the inwardly protruding lugs of the working sleeve. Initial engagement results in the corners of the teeth contacting the corners of the square heads of the lugs, so that the lugs rotate as they are contacted. This allows some slippage during engagement. As the working sleeve moves further axially, the flat faces of the teeth contact the corresponding flat faces of the lugs to impart full rotational force thereto, resulting in complete lockup of the working sleeve with the rotation of the intermediate cylinders and driveshaft. Clutch engagement may be intermittent with this embodiment.

The third embodiment incorporates a combination of friction engagement through friction surfaces between the working sleeve and any of the rotating surfaces; and/or a mechanical engagement through a dog clutch at each end of the central working sleeve. The sleeve is normally free to rotate relative to the driveshaft, or to remain stationary relative to the rotating shaft, but will engage first the friction coupling surfaces when translated axially along the shaft. If the transmitted torque through the friction coupling surfaces is not enough to perform the required task, mechanical engagement through a multi teeth dog clutch at either end thereof when translated axially along the shaft will take place to transmit the full system torque to the working sleeve. Springs are installed at each end of the sleeve to hold the sleeve clear of the different clutches unless some predetermined axial force causes the sleeve to move certain axial amount along the shaft. As an example, if the working sleeve hangs up as the drill string progresses through the borehole, at certain predetermined force amount, the friction coupling surfaces installed between the working sleeve and the rotating system (shaft and/or housing) will engage transmitting certain amount of torque from the rotating system to the working sleeve, if this amount of torque is not enough, full torque will be transmitted by mechanical engagement between the dog clutch components installed on the drill string and the mating component on the corresponding end of the working sleeve, thereby causing the sleeve to rotate in unison with the shaft to wipe out the obstruction upon which it is caught, using the full drill string torque. Clutch engagement will be gradual and smooth with this embodiment.

These and other features of the present disclosure will become readily apparent upon further review of the following specification and drawings.

BRIEF DESCRIPTION OF THE DRAWINGS

Similar reference characters denote corresponding features consistently throughout the attached drawings.

BEST MODE(S) FOR CARRYING OUT THE INVENTION

Figure 1:
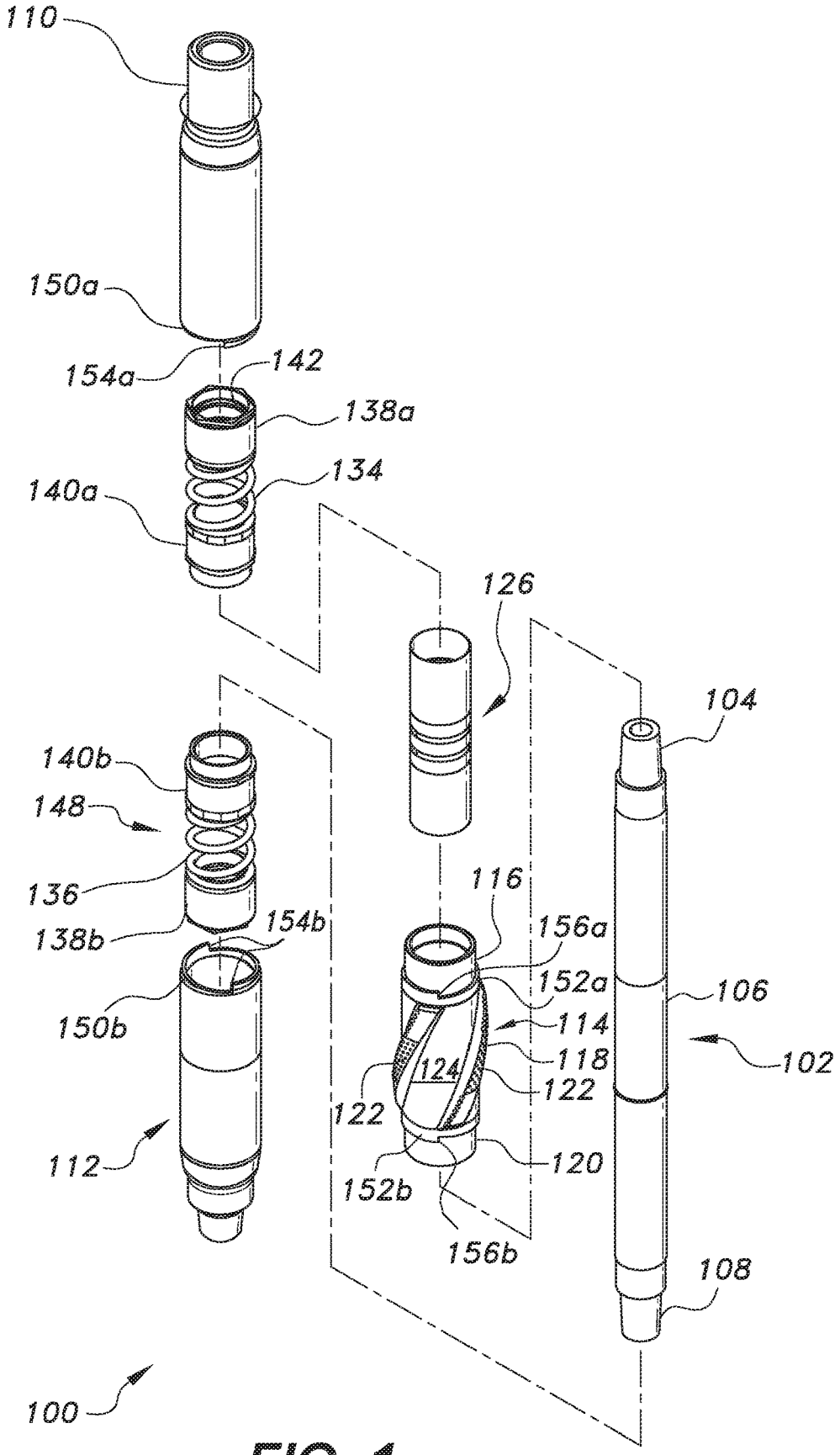
FIG. 1 is an exploded perspective view of a first embodiment of a multifunction wellbore conditioning tool, illustrating its various components.
Figure 2:
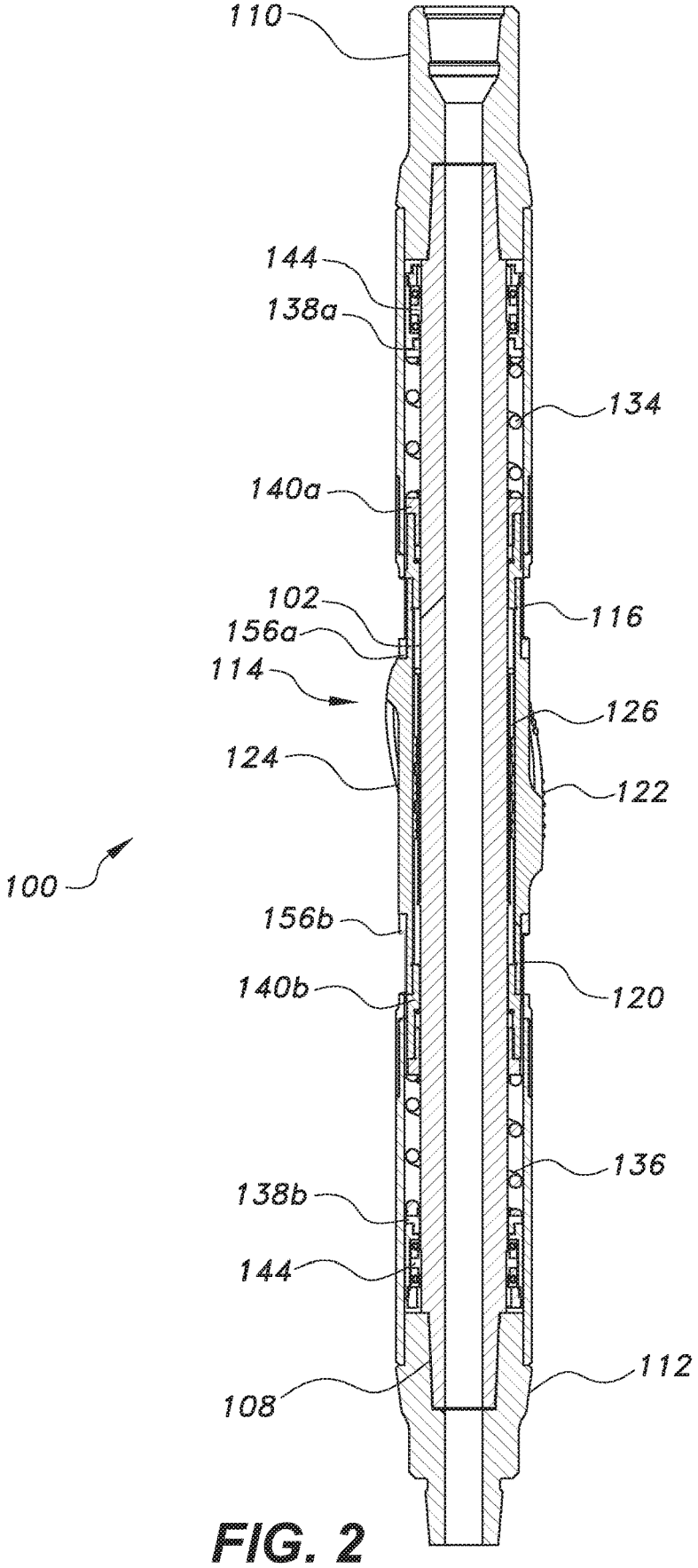
FIG. 2 is an elevation view in section of the multifunction wellbore conditioning tool embodiment of FIG. 1, illustrating further details thereof.

The multifunction wellbore conditioning tool is a tool having a central working sleeve disposed concentrically upon a shaft. The sleeve engages rotationally with the shaft or disengages rotationally from the shaft, depending upon axial shifting of the sleeve and corresponding engagement of coupling mechanism at each end of the sleeve and/or a friction coupling mechanism at different locations on the sleeve. The sleeve can perform the functions of a cutter, reamer, friction reducer, keyseat wiper and/or stabilizer, depending upon wellbore wall diameter and sleeve engagement condition.

FIGS. 1 through 3B illustrate a first embodiment of the multifunction wellbore conditioning tool, or simply tool, 100. The tool 100 includes an elongate, rigid central shaft 102 having a first end portion 104, a central portion 106, and a second end portion 108 opposite the first end portion 104. A generally cylindrical first housing 110 is affixed rotationally and axially (i.e., immovably affixed) concentrically to the first end portion 104 of the shaft 102. A generally cylindrical second housing 112 is immovably affixed concentrically to the second end portion 108 of the shaft 102.

A working sleeve 114 is installed about the central portion 106 of the shaft 102 between the first and second housings 110 and 112, and is free to move rotationally and axially relative to the shaft 102, unless it is locked with one of the two housings 110 and 112, as described further below. The sleeve 114 has a first end portion 116, a central portion 118, and a second end portion 120 opposite the first end portion 116. The working sleeve (sleeve 114) includes a plurality of straight or helically disposed external cutting elements 122 separated by straight or helical flutes 124 therebetween, the cutting elements 122 permitting the sleeve 114 to function as a combination cutter, keyseat wiper, friction reducer, reamer, keyseat wiper, and stabilizer. Additional cutting elements, e.g., PDC (polycrystalline diamond compacts) are provided at the reduced diameter upper and lower ends of each of the straight or helical bands of cutting elements 122. Rotational and axial translational friction between the sleeve 114 and shaft 102 is reduced by a bearing system, a plurality of roller bearings, sleeve bearings, ball bearing, elongate, cylindrical needle bearings, or, special design bearing. A ball bearing system 126 disposed between the shaft 102 and the working sleeve 114. Alternatively, other bearing means, such as roller bearings, deep groove bearings, rolling elements, cylindrical needle bearings, sleeve bearings, or special design bearings may be used to allow the sleeve 114 to rotate and translate axially.

The working sleeve 114 is retained in a neutral position on the central portion 106 of the shaft 102, clear of the two housings 110 and 112, by first and second spring sets 134 and 136 installed concentrically about the shaft 102 between the first end 104 and the central portion 106 and between the second end 108 the central portion 106, respectively, of the shaft 102 and within the first and second housings 110 and 112 to bear against the first and second spring seat 140*a* and second spring seat 140*b*, which are connected to ends 116 and 120 respectively, respectively, of the working sleeve 114 through, respectively, the bearing seats 140*a* and 140*b*. The first spring 134 is secured to a first thrust transmitting system 138*a* and a first spring seat 140*a*, and the second spring 136 is secured to a second thrust transmitting system 138*b* and second spring seat 140*b* in a similar manner, but in mirror image to the first spring 134 and its corresponding thrust transmitting system 138*a* and spring seat 140*a*. Thus, the first spring 134, first thrust transmitting system 138*a*, and first spring seat 140*a* are rotationally fixed to one another, as are the second spring 136, second thrust transmitting system 138*b*, and second spring seat 140*b*. The two thrust transmitting system 138*a*, 138*b* are either retained within their respective housings 110 and 112 by keys that are inserted into corresponding keyholes or slots in the sides of the housings 110 and 112, and into outer circumferential grooves formed about the two thrust transmitting system 138*a*, 138*b*, or, retained to the shaft by thrust carrying disc 142 attached to the shaft and into inner circumferential grooves formed about the two thrust transmitting system 138*a*, 138*b*, or, the two thrust transmitting system 138*a*, 138*b* can be attached free. This construction allows the working sleeve 114 to rotate freely relative to the shaft 102, or considered in another manner, the shaft 102 may rotate freely within the sleeve 114. This also allows the two springs 134, 136 to work together to create a spring assembly of equivalent stiffness equal to the combined stiffness of the individual springs depending on the spring sets attachment technique. Alternatively, spring sets 134 and 136 can be replaced with disc springs installed concentrically about shaft 102 and within the first and second housings 110 and 112 to bear against the first and second ends 116 and 120, respectively, of the working sleeve 114. In this configuration, the disc springs are working independently of each other and each is rated to the full required spring stiffness needed to control the axial position and clutching of working sleeve 114.

Each housing 110, 112 has a sleeve engagement end 150*a* and 150*b*, the two ends 150*a*, 150*b* facing one another. The working sleeve 114 has first and second housing engagement ends 152*a* and 152*b*, disposed about the respective opposite first and second end portions 116 and 120 of the sleeve. The sleeve engagement end 150*a* of the first housing 110 and the adjacent housing engagement end 152*a* of the first end portion 116 of the working sleeve 114 collectively comprise a first clutch mechanism. Similarly, the sleeve engagement end 150*b* of the second housing 112 and the adjacent housing engagement end 152*b* of the second end portion 120 of the working sleeve 114 collectively comprise a second clutch mechanism. In the case of the first embodiment tool 100 of FIGS. 1 through 3B, the first and second clutch mechanisms comprise first and second dog clutches, i.e., mechanisms that lock up abruptly to apply full drill string torque to the working sleeve due to sudden solid contact between mating teeth or other protrusions.

Figure 3A:
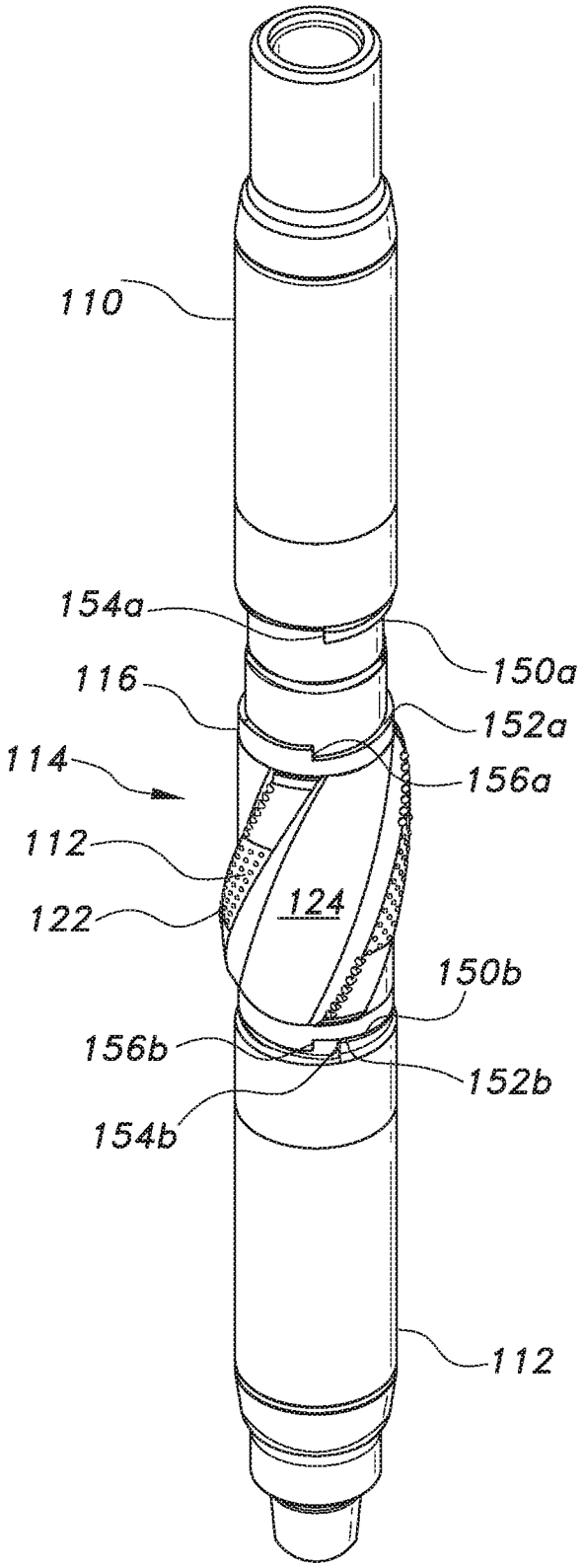
FIG. 3A is a perspective view of the assembled multifunction wellbore conditioning tool of FIG. 1, showing a working sleeve shifted axially toward the lower end of the assembly to engage rotationally with the lower portion of the tool.
Figure 3B:
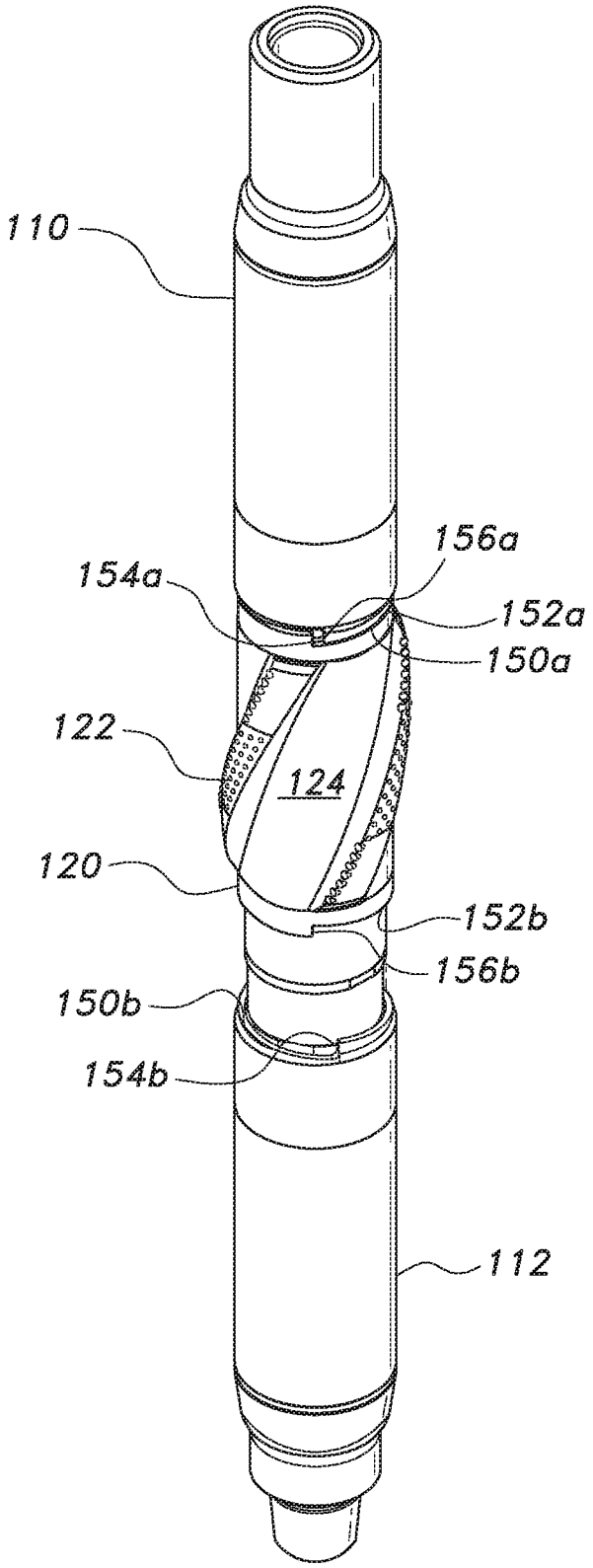
FIG. 3B is a perspective view of the assembled multifunction wellbore conditioning tool of FIG. 1, showing the working sleeve shifted axially toward the upper end of the assembly to engage rotationally with the upper portion of the tool.
Figure 4:
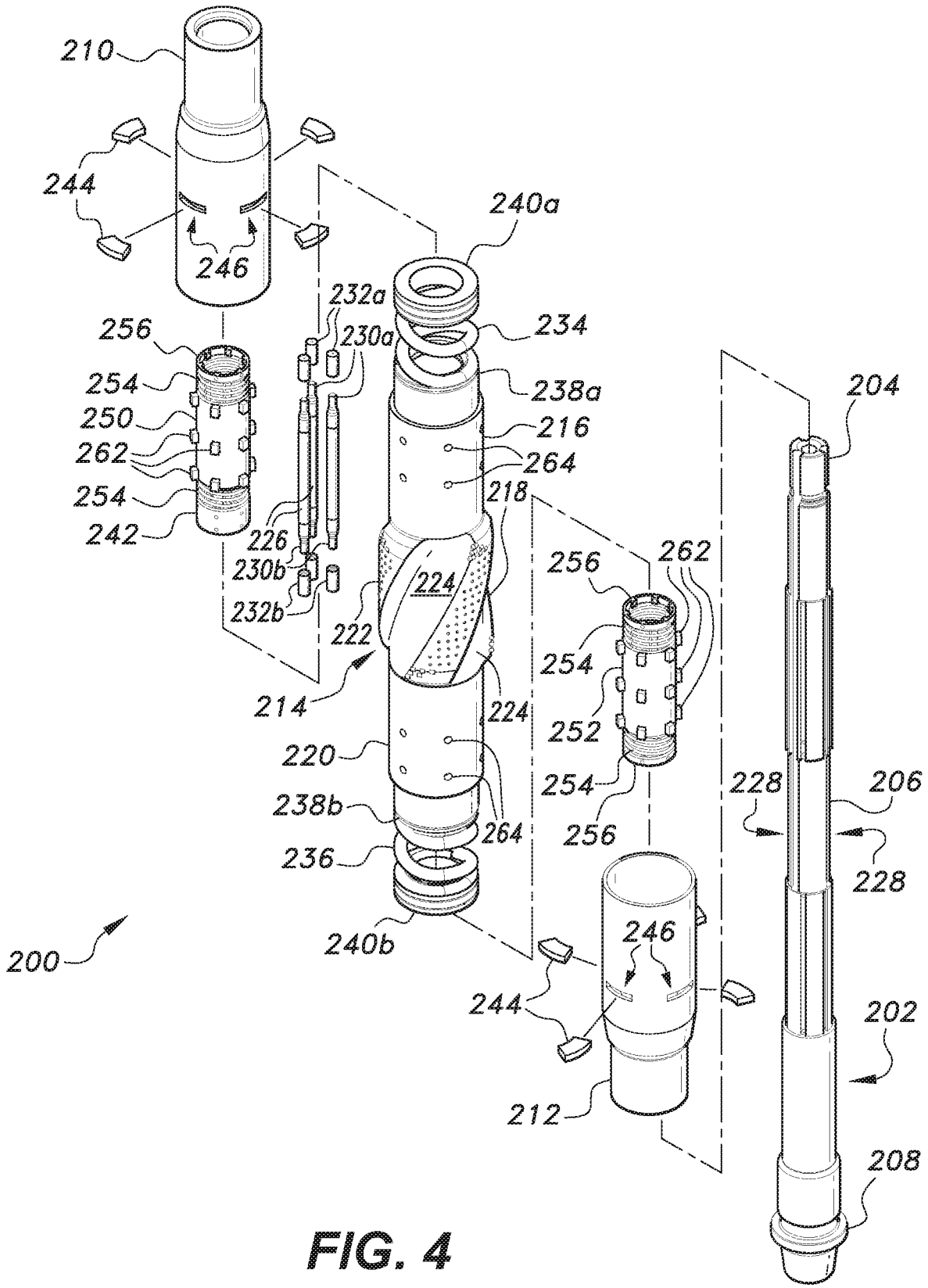
FIG. 4 is an exploded perspective view of a second embodiment of a multifunctional wellbore conditioning tool, illustrating its various components.
Figure 5:
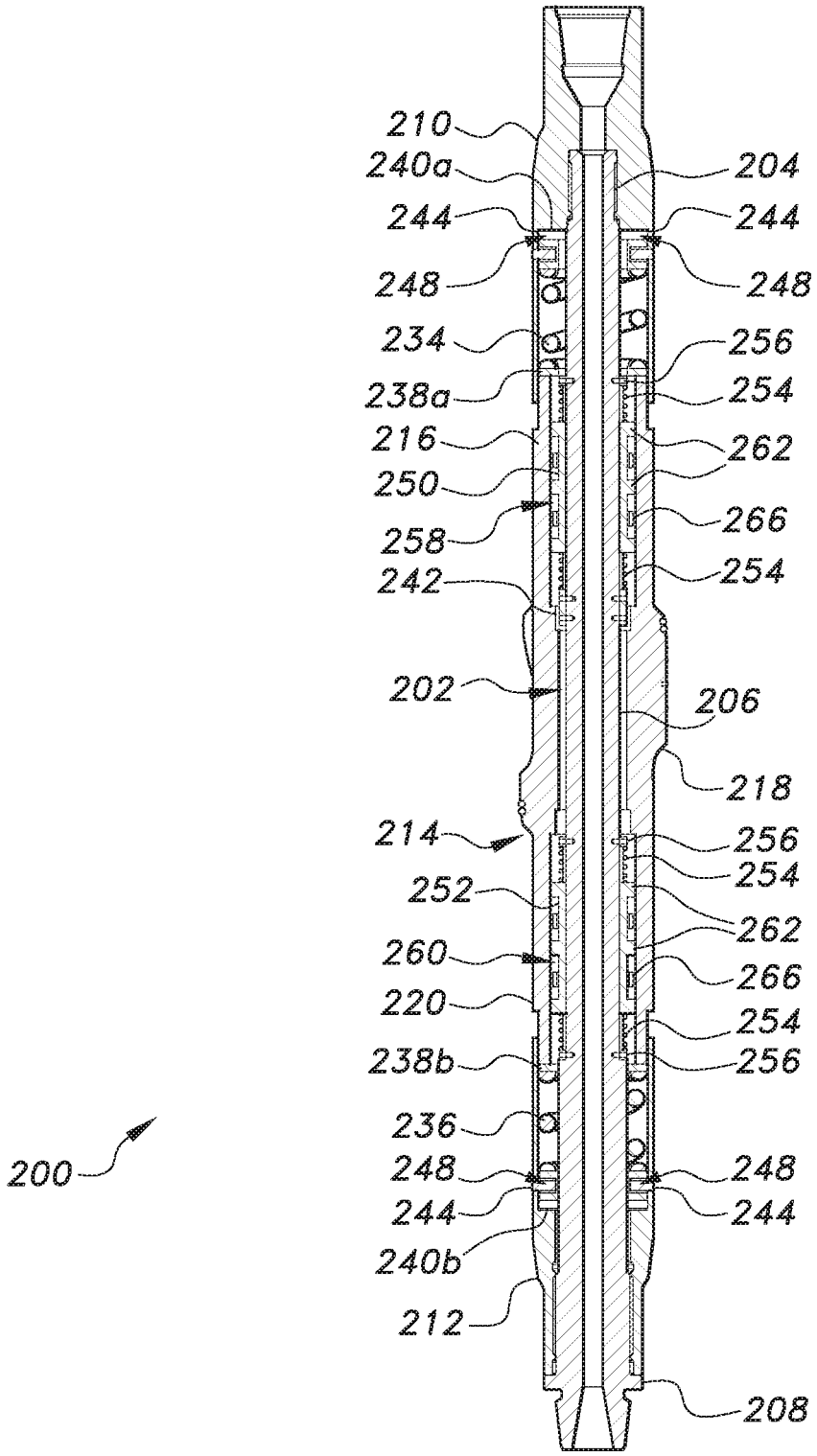
FIG. 5 is an elevation view in section of the multifunction wellbore conditioning tool of FIG. 4, illustrating further details thereof.

The first dog clutch mechanism of the tool 100 comprises a first pair of axially oriented teeth or faces 154*a* (one such tooth being shown in FIGS. 1 through 3B) on the sleeve engagement end 150*a* of the first housing 110, which selectively engage corresponding teeth or faces 156*a* extending from the sleeve engagement end 152*a* of the first end portion 116 of the sleeve 114. The teeth 154*a* of the first housing 110 are circumferentially distributed and separated by protruded ramps. Similarly, the teeth 156*a* of the first end portion 116 of the sleeve 114 are circumferentially distributed and have spiral ramps extending therebetween. This construction causes the first dog clutch to lock up, i.e., to cause the working sleeve 114 to rotate in unison with the housing 110 (and thus the shaft 102) when the shaft 102 and housing 110 are rotating in a clockwise direction when viewed from above, as shown in FIG. 3B. However, the ramp configuration between the teeth allows the dog clutch mechanism to slip when the housing 110 rotates counterclockwise relative to the sleeve 114. Thus, if the working sleeve 114 encounters axial resistance sufficient to override the compression of the first spring 134 and the tensile force of the second spring 136, or the corresponding stack of disc springs used instead, and force the two components of the first dog clutch into engagement with one another, the sleeve 114 will be forced into rotation in unison with the shaft 102 and housing 110 by engagement of the first dog clutch mechanism, thereby reaming or otherwise conditioning the borehole by application of the full drill string torque to the working sleeve 114 as drilling continues.

In the event that the working sleeve 114 "hangs up" or is caught on some protrusion as the drill string (and thus the shaft 102) is withdrawn from the borehole, the shaft 102 will be drawn upward through the sleeve 114. If sufficient tensile force is applied to the sleeve 114, it will cause the second spring 136 to compress and the first spring 134 to extend to the extent that the two sets of dog clutch teeth 154*b* and 156*b* of the second end of the assembly will engage. This engagement of the first clutch assembly or mechanism is illustrated in FIG. 3A of the drawings. It will be noted that this engagement will only occur if the shaft 102 (and the second housing 112 immovably affixed thereto) is rotating in a clockwise direction when viewed from above. Rotation of the shaft 102 and housing 112 in the opposite direction will allow the sloped or ramp surfaces to slide relative to one another, without rotary engagement of the working sleeve 114. It will be seen that the orientation of the sloped surfaces between each of the axial teeth 154*a*, 156*a* and 154*b*, 156*b* may be reversed for drill strings that rotate in a counter-clockwise direction. Also, more than two such teeth may be formed on the ends of the two housings 110, 112 and the facing ends of the central working sleeve 114, if desired. This will result in more rapid lockup of the sleeve 114 with either of the ends 110 or 112, but the two teeth provided in each clutch provide for lockup after no more than 180° of rotation in the exemplary tool 100 of FIGS. 1 through 3B, which is sufficient.

The second embodiment of the tool, designated as tool 200 in FIGS. 4 through 8B, provides an end function much the same as that of the tool 100, but the clutch mechanism of the tool 200 is different from that of the tool 100 and provides an intermittent application of drill string force to the working sleeve during engagement. Accordingly, corresponding components of the tool 200 are designated by reference numerals identical to those of the tool 100 of the first embodiment, with the exception of the first digit. The number "2" is used as the first digit for all components of the tool 200 of FIGS. 4 through 8B.

Accordingly, the tool 200 includes an elongate, rigid central shaft 202 having a first end portion 204, a central portion 206, and a second end portion 208 opposite the first end portion 204. A generally cylindrical first housing 210 is affixed rotationally and axially (i.e., immovably affixed) concentrically to the first end portion 204 of the shaft 202, and a generally cylindrical second housing 212 is immovably affixed concentrically to the second end portion 208 of the shaft 202.

A working sleeve 214 is installed about the central portion 206 of the shaft 202 between the first and second housings 210 and 212 and is free to move rotationally and axially relative to the central shaft 202, unless it is locked with the shaft 202, as described further below. The sleeve 214 has a first end portion 216, a central portion 218, and a second end portion 220 opposite the first end portion 216. The working sleeve (sleeve 214) includes a plurality of straight or helically disposed external cutting elements 222 separated by straight or helical flutes 224 therebetween. Additional cutting elements, e.g., PDC (polycrystalline diamond compacts) are provided at the lower diameter, upper and lower ends of each of the straight or helical bands of cutting elements 222, similar to the configuration of cutting elements in the first embodiment 100. The various cutting elements permit the sleeve 214 to function as a combination cutter, keyseat wiper, friction reducer, reamer, keyseat wiper, and stabilizer. Rotational friction between the sleeve 214 and shaft 202 is reduced by a plurality of elongate, cylindrical needle bearings 226 disposed between the shaft 202 and the working sleeve 214. The needle bearings 226 reside in mating longitudinal roller channels 228 formed in the side of the central shaft 202. The needle bearings 226 have mutually opposed first and second ends 230*a* and 230*b*, supported by respective first and second bearing seats 232*a* and 232*b* that are installed in the first and second housings 210 and 212, respectively. Alternatively, other bearing means, such as roller or sleeve bearings, may be used to allow the sleeve 114 to rotate and translate axially.

The working sleeve 214 is retained in a neutral position on the central portion 206 of the shaft 202 between the two housings 210 and 212 by first and second spring sets 234 and 236 installed concentrically about the first and second ends 204 and 208, respectively, of the shaft 202 and within the first and second housings 210 and 212 to bear against the first and second ends 216 and 220, respectively, of the working sleeve 214. The first spring 234 is secured to a first thrust transmitting system 238*a* and a first spring seat 240*a*, and the second spring 236 is secured to a second thrust transmitting system 238*b* and second spring seat 240*b* in a similar manner, but in mirror image to the first spring 234 and its corresponding thrust transmitting system 238*a* and spring seat 240*a*. The two springs 234, 236 are rotationally affixed to their respective thrust transmitting system and spring seats, as in the tool 100 of FIGS. 1 through 3B.

A collar 242 is also disposed concentrically within the working sleeve 214 and serves as a holder for the first bearing seats 232*a* and operates in conjunction with one of the clutch elements of the tool 200 embodiment, described further below. The two spring seats 240*a*, 240*b* are retained within their respective housings 210 and 212 by keys 244 that insert into corresponding keyholes or slots 246 in the sides of the housings 210 and 212, and into circumferential grooves 248 formed about the two spring seats 240*a* and 240*b*. This construction allows the working sleeve 214 to rotate freely relative to the shaft 202, or considered in another manner, the shaft 202 may rotate freely within the sleeve 214.

The embodiment of the tool 200 of FIGS. 4 through 8B differs from the embodiment of the tool 100 of FIGS. 1 through 3B in its clutch configuration, as noted further above. The first and second clutch mechanisms of the tool 200 include first and second intermediate cylinders 250 and 252, respectively. The first intermediate cylinder 250 is installed between the first end portion 204 (which extends along a substantial portion) of the shaft 202 and the first end portion of the working sleeve 214. The second intermediate cylinder 252 is installed between the second end portion 208 of the shaft 202 and the second end portion of the working sleeve 214. Each intermediate cylinder 250 and 252 is free to move axially about the shaft 202, to a limited extent, by means of suitable spring sets 254 installed at each end of each cylinder 250 and 252. This axial movement of the cylinders 250 and 252 allows gradual application of drill string force during engagement of the clutch mechanisms, as described further below. The springs 254 are restrained at their ends opposite the intermediate cylinders 250 and 252 by collars 256 secured to the shaft 202, and by the collar 242.

First and second annular volumes 258 and 260, respectively, are defined between the intermediate cylinders 250 and 252 and the adjacent portions of the working sleeve 214. A plurality of rectangular solid teeth 262 are immovably affixed to the outer surface of each of the intermediate cylinders 250 and 252 and extend outward therefrom into the respective annular volumes 258 and 260 between the cylinders 250, 252 and the concentrically surrounding working sleeve 214. The sleeve 214 includes a plurality of circular passages 264 formed through the wall of the first and second end portions 216, 220. A corresponding plurality of rectangular solid tooth engaging lugs 266 is installed in the passages 264, each of the lugs 266 having a cylindrical pin 268 rotatably disposed in a corresponding passage 264, while the rectangular solid tooth engagement portion extends inward from the corresponding pin 268 into the annular volumes 258, 260. This construction is shown in detail in FIGS. 7A through 8B. The cylindrical pins 268 allow each of the rectangular lugs 266 to rotate on the inner wall of the working sleeve 214 about the corresponding pins 268.

Figure 6A:
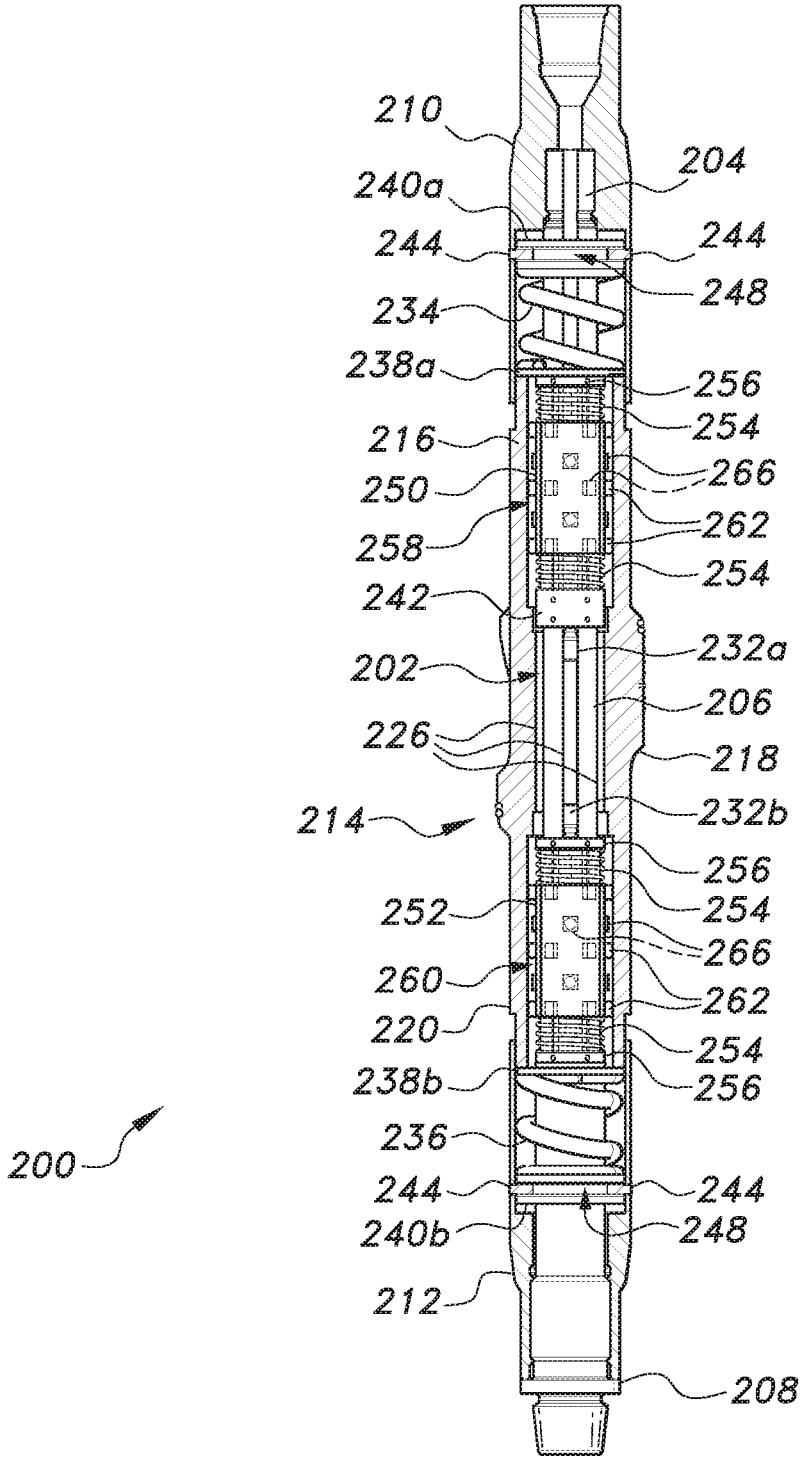
FIG. 6A is an elevation view in section of the multifunction wellbore conditioning tool of FIG. 4, showing the working sleeve rotationally disengaged from the remainder of the tool.

So long as there is no axial force acting upon the working sleeve 214 relative to the shaft 202, the sleeve 214 is held in an axially neutral position relative to the first and second intermediate cylinders 250 and 252 by the first and second springs 234 and 236, as shown in FIG. 6A. It will be seen in FIG. 6A that the teeth 262 of the intermediate cylinders 250 and 252 are not aligned in the same cross-sectional plane as the lugs 266 of the sleeve 214. This allows the sleeve 214 to rotate relative to the intermediate cylinders 250 and 252, or in other words, for the intermediate cylinders 250 and 252 (and the shaft 202 to which the intermediate cylinders are rotationally fixed, e.g., by mating splines, etc.) to rotate relative to the working sleeve 214.

Figure 6B:
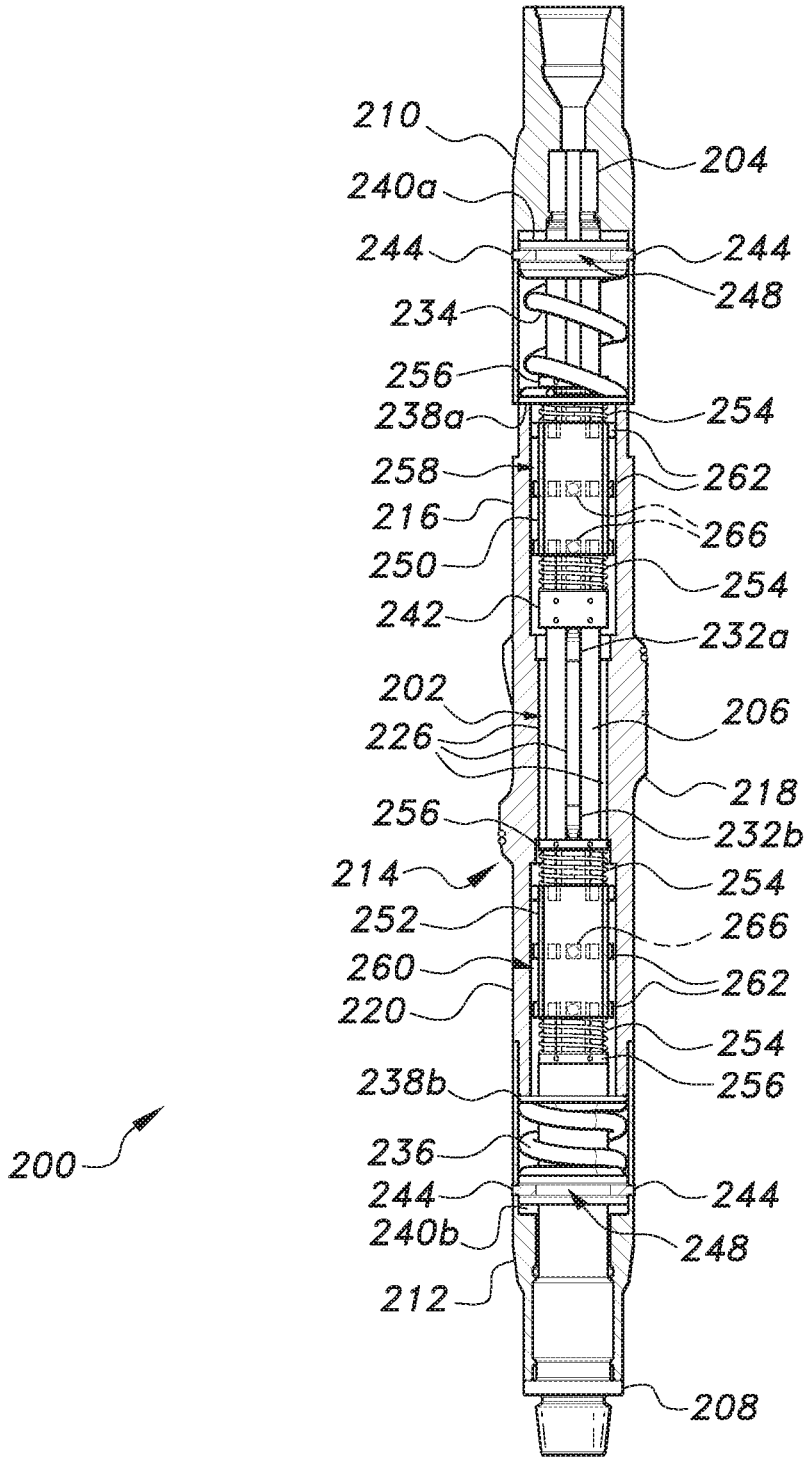
FIG. 6B is an elevation view in section of the multifunction wellbore conditioning tool of FIG. 4, showing the working sleeve shifted axially toward the lower end of the assembly to engage the working sleeve rotationally with the remainder of the tool.

In FIG. 6B, the configuration of the tool 200 is shown as it would function when the drill string and shaft 202 are lifted or withdrawn from the borehole, the working sleeve 214 resisting withdrawal for some reason. In this case, the shaft 202 is drawn axially to slide through the sleeve 214, compressing the second spring 236 and applying tension to the first spring 234, substantially aligning the lugs 266 of the sleeve 214 with the teeth 262 extending radially from the two intermediate cylinders 250 and 252. As the lugs 266 and the teeth 262 engage one another (i.e., clutch engagement), the sleeve 214 is forced to rotate with the shaft 202. FIGS. 7A through 7E depict the engagement of the clutch mechanism of the second embodiment 200.

Figure 6C:
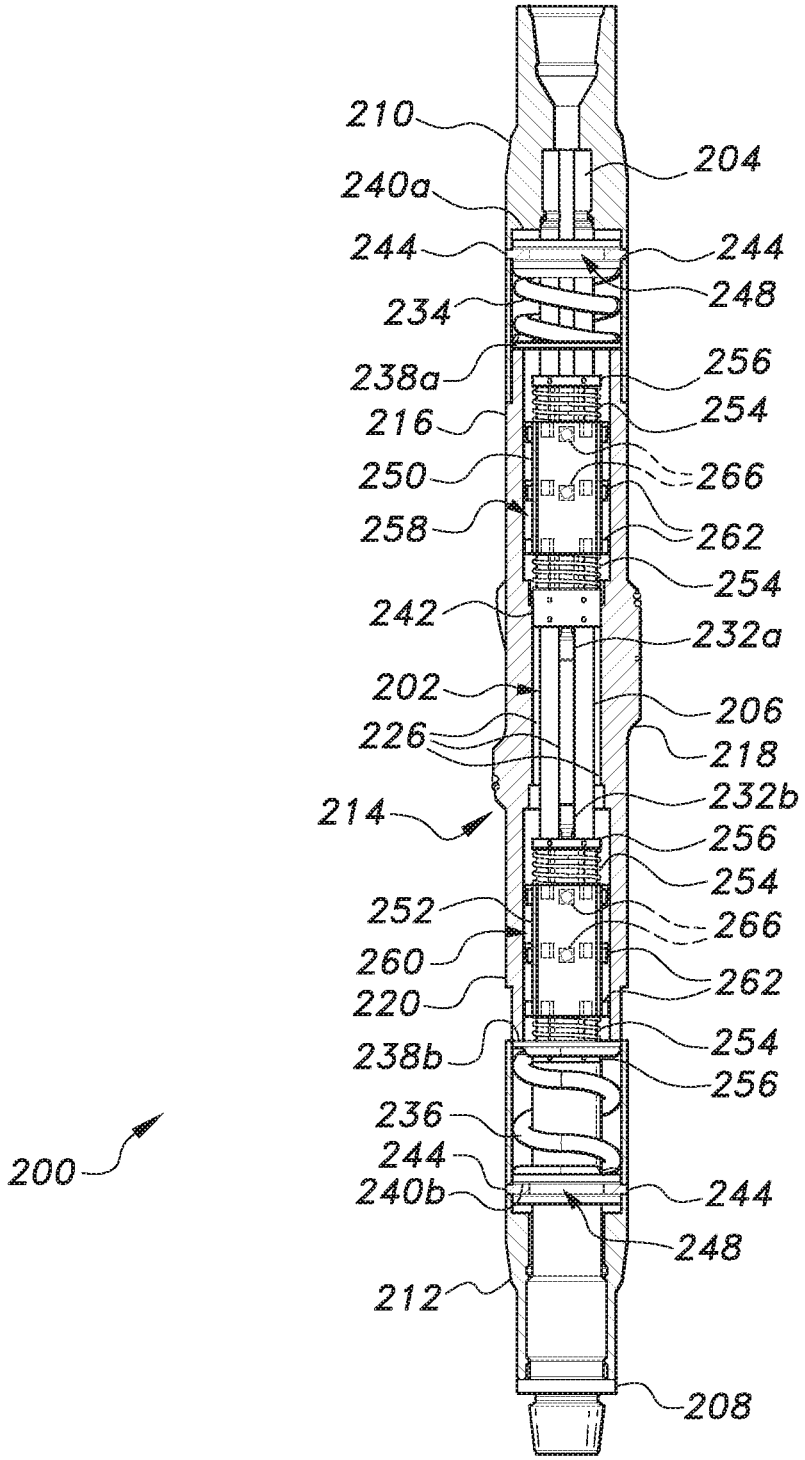
FIG. 6C is an elevation view in section of the multifunction wellbore conditioning tool of FIG. 4, showing the working sleeve shifted axially toward the upper end of the assembly to engage the working sleeve rotationally with the remainder of the tool.

In FIG. 6C, the configuration of the tool 200 is shown as it would function when the drill string and shaft 202 pass downward through the borehole, the working sleeve 214 resisting downward travel with the shaft 202 for some reason. In this case, the shaft 202 is drawn axially to slide through the sleeve 214, compressing the first spring 234 and applying tension to the second spring 236, substantially aligning the lugs 266 of the sleeve 214 with the teeth 262 extending radially from the two intermediate cylinders 250 and 252, as in the example of FIG. 6B. As the lugs 266 and the teeth 262 engage one another (i.e., clutch engagement), the sleeve 214 is again forced to rotate with the shaft 202.

Figure 7A:
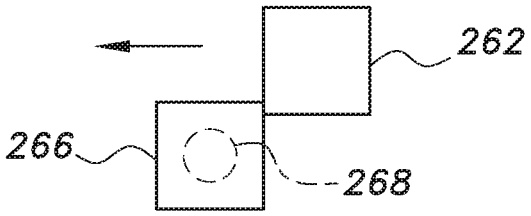
FIGS. 7A, 7B, 7C, 7D, and 7E are a sequence of schematic top views, showing the progressive engagement and passage of relatively rotating components of the multifunction wellbore conditioning tool embodiment of FIG. 4.
Figure 7B:
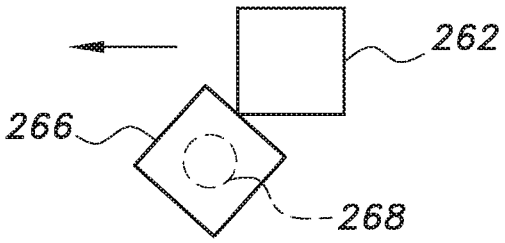
Figure 7C:
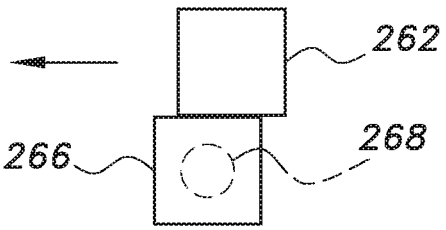
Figure 7D:
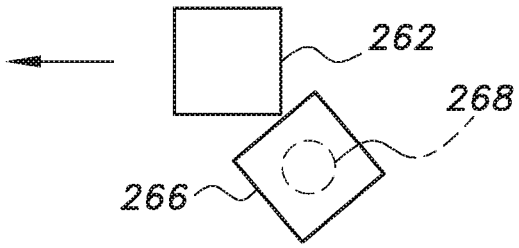
Figure 7E:
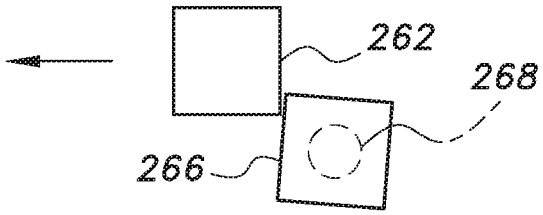

The clutch mechanisms, comprising the rotating lugs 266 of the working sleeve 214 and teeth 262 of the intermediate cylinders 250 and 252, provide for a more gradual lockup of rotation and application of drill string torque between the sleeve 214 and shaft 202 than is enabled by the dog clutch mechanism of the first embodiment of the tool 100. FIGS. 7A through 7E illustrate the operation of a single rotating lug 266 of the working sleeve relative to a corresponding tooth 262 of the intermediate cylinders, it being understood that all of the rotating lugs 266 and teeth 262 operate in the same manner. In FIG. 7A, rotation of the drill string and shaft has resulted in relative movement of the tooth 262 against the lug 266. It will be seen that if the tooth 262 and lug 266 are substantially misaligned with one another, the force between the two will be corner-to-corner, as shown in FIG. 7A. However, the rotary attachment of the lug 266 to the inner wall of the working sleeve by means of its pin 268 results in the asymmetric force causing the lug 266 to rotate, as shown in FIG. 7B. Continued movement between the two components 262 and 266 results in the tooth 262 sliding over the lug 266 while the lug 266 rotates (due to its pin 268), as shown in FIG. 7C. The springs 254 at each end of the first and second intermediate cylinders 250 and 252 permit the cylinders to move axially relative to the working sleeve 214 and the rotating lugs 266, thus allowing the tooth 262 to pass by the lug 266, rather than catching on a diagonally oriented corner. Continued motion of the tooth 262 past the lug 266 results in the lug 266 rotating further, as shown in FIGS. 7D and 7E, while the springs 254 urge the intermediate cylinders 250 and 252 back into their neutral positions. As the tooth 262 continues to move beyond the lug 266, relative motion or slippage remains between the two components, i.e., there is no rotational lockup between the two and the transfer of torque between the two components is more gradual than the abrupt lockup of the dog clutch mechanism of the first embodiment of the tool 100 of FIGS. 1 through 3B.

Figure 8A:
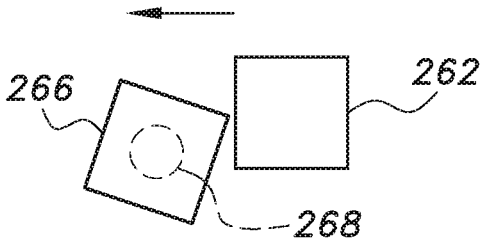
FIGS. 8A and 8B are a sequence of schematic top views showing additional views of the engagement and rotational locking of relatively rotating components of the multifunction wellbore conditioning tool embodiment of FIG. 4.
Figure 8B:
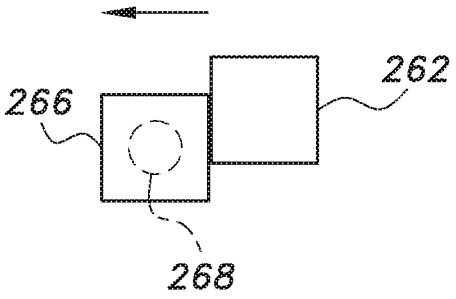
Figure 9:
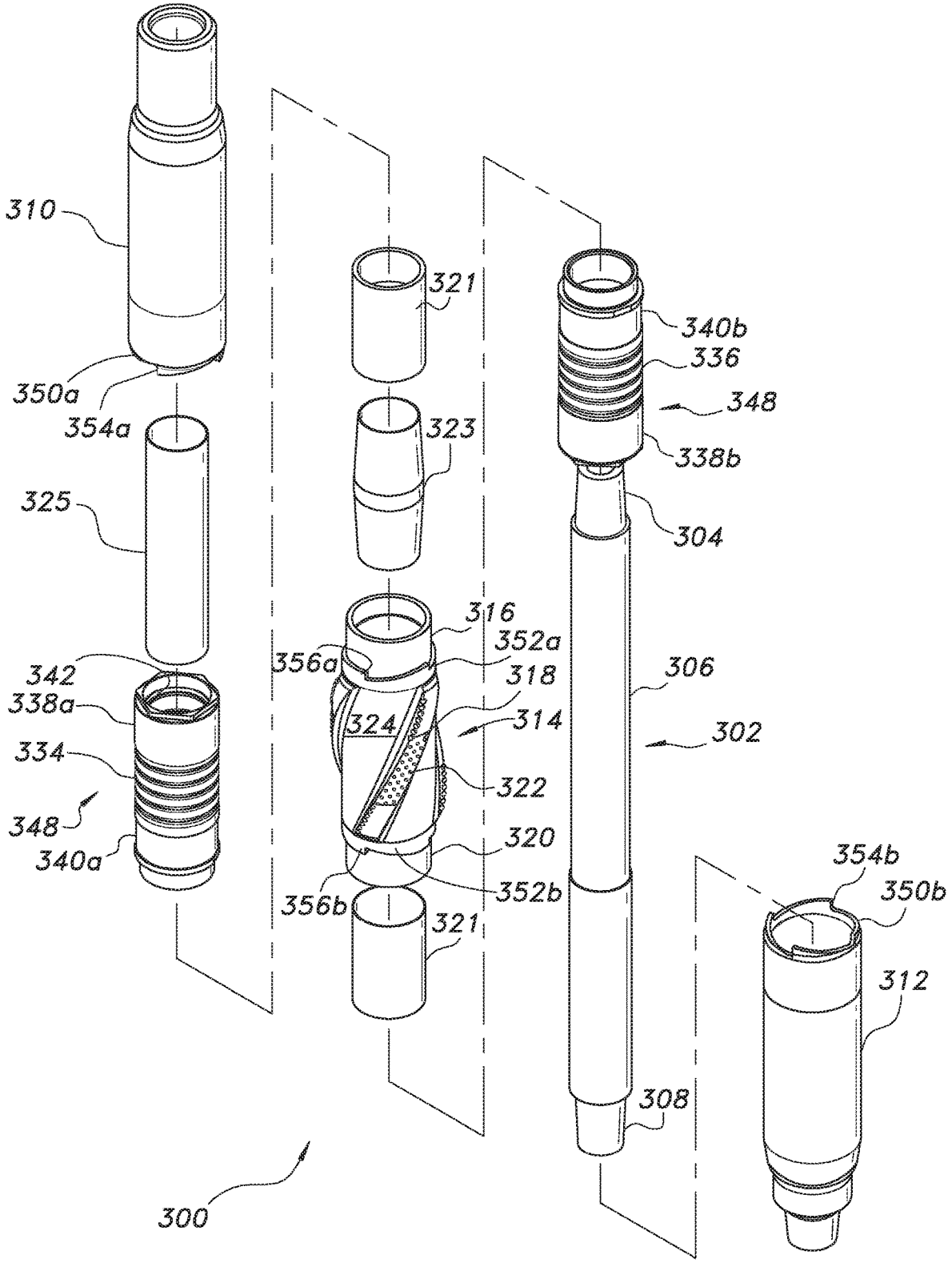
FIG. 9 is an exploded perspective view of a further alternative embodiment of a multifunction wellbore conditioning tool.
Figure 10:
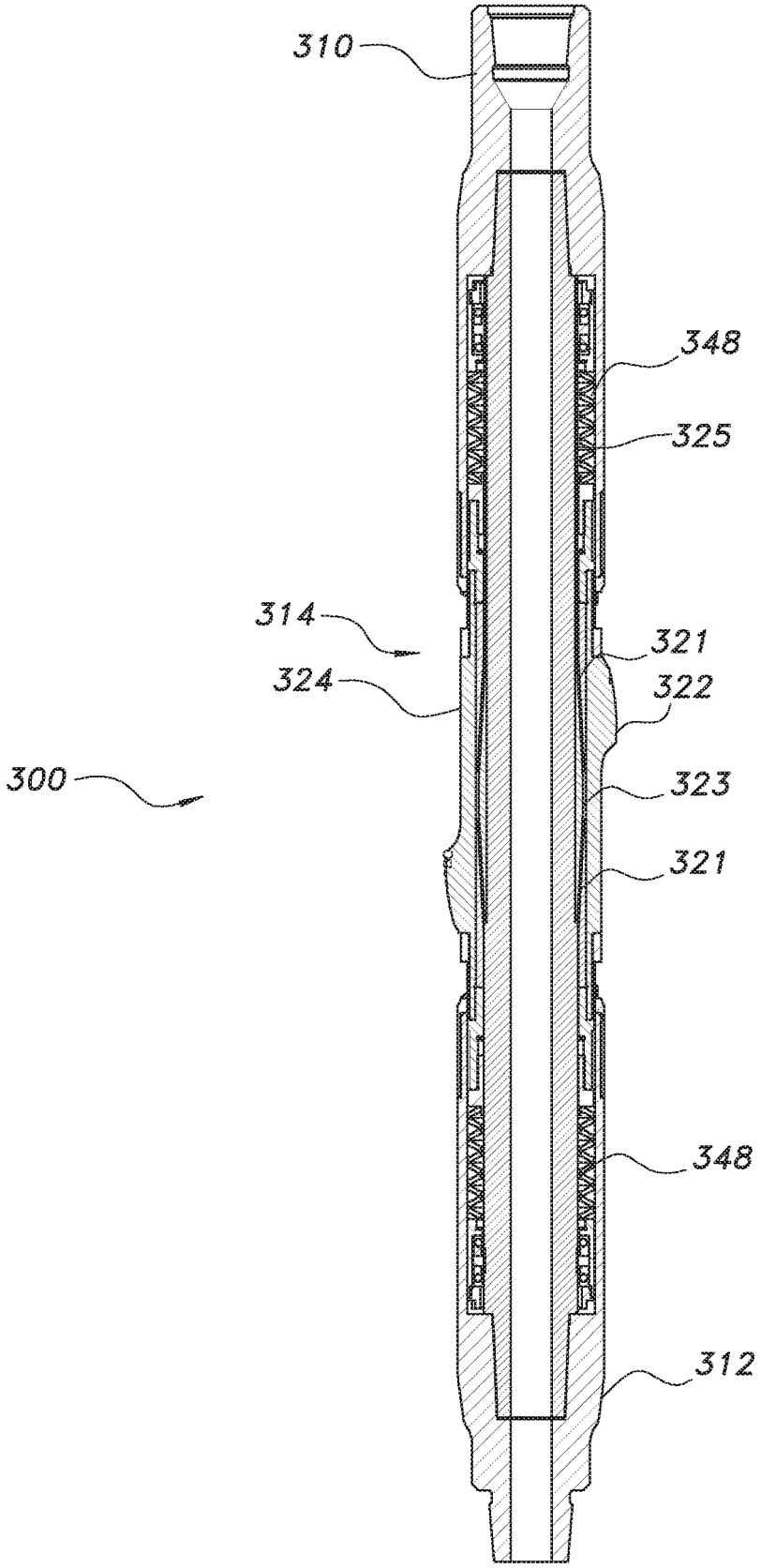
FIG. 10 is an elevation view in section of the multifunction wellbore conditioning tool embodiment of FIG. 9.

FIGS. 8A and 8B illustrate a case where the rotary plane of the tooth 262 is more closely aligned with the plane of the lug 266. In this case, the tooth 262 extends beyond the center of the lug 266, so that the force developed between the two is more symmetrical or centered. As this prevents the lug 266 from rotating, the transfer of torque between the two components is complete, and unitary rotary motion is developed between the two components and their associated shaft 202 and working sleeve 214.

The third embodiment of the tool, designated as tool 300 in FIGS. 9 through 11B, provides an end function much the same as that of the tools 100 and 200, with adding a combined friction and mechanical coupling mechanisms, a full gradual application of drill string force to the working sleeve during engagement will be achieved. The tool 300 includes an elongate, rigid central shaft 302 having a first end portion 304, a central portion 306, and a second end portion 308 opposite the first end portion 304. A generally cylindrical first housing 310 is affixed rotationally and axially (i.e., immovably affixed) concentrically to the first end portion 304 of the shaft 302. A generally cylindrical second housing 312 is immovably affixed concentrically to the second end portion 108 of the shaft 302.

A working sleeve 314 is installed about the central portion 306 of the shaft 302 between the first and second housings 310 and 312, and is free to move rotationally and axially relative to the shaft 302, unless friction coupling sleeves 321 and 323 gets engaged, or, it is locked with one of the two housings 110 and 112, as described further below. The sleeve 314 has a first end portion 316, a central portion 318, and a second end portion 320 opposite the first end portion 316. The working sleeve (sleeve 314) includes a plurality of straight or helically disposed external cutting elements 322 separated by straight or helical flutes 324 therebetween, the cutting elements 322 permitting the sleeve 314 to function as a combination cutter, keyseat wiper, friction reducer, reamer, keyseat wiper, and stabilizer. Additional cutting elements, e.g., PDC (polycrystalline diamond compacts) are provided at the reduced diameter upper and lower ends of each of the straight or helical bands of cutting elements 322. Rotational and axial translational friction between the sleeve 314 and shaft 302 is reduced by a bearing system, a plurality of roller bearings, sleeve bearings, ball bearing, elongate, cylindrical needle bearings, or, special design bearing. A sleeve bearing system 321 disposed between the shaft 302 and the working sleeve 314. Alternatively, other bearing means, such as roller bearings, deep groove bearings, rolling elements, cylindrical needle bearings, sleeve bearings, or special design bearings may be used to allow the sleeve 314 to rotate and translate axially.

The working sleeve 314 is retained in a neutral position on the central portion 306 of the shaft 302, clear of the two housings 310 and 312, by first and second spring sets 334 and 336 installed concentrically about the shaft 302 between the first end 304 and the central portion 306 and between the second end 308 the central portion 306, respectively, of the shaft 302 and within the first and second housings 310 and 312 to bear against the first and second spring seat 340*a* and second spring seat 340*b*, which are connected to ends 316 and 320 respectively, respectively, of the working sleeve 314 through, respectively, the bearing seats 340*a* and 340*b*. The first spring 334 is secured to a first thrust transmitting system 338*a* and a first spring seat 340*a*, and the second spring 336 is secured to a second thrust transmitting system 338*b* and second spring seat 340*b* in a similar manner, but in mirror image to the first spring 334 and its corresponding thrust transmitting system 338*a* and spring seat 340*a*. Thus, the first spring 334, first thrust transmitting system 338*a*, and first spring seat 340*a* are rotationally fixed to one another, as are the second spring 336, second thrust transmitting system 338*b*, and second spring seat 340*b*. The two thrust transmitting system 338*a*, 338*b* are either retained within their respective housings 310 and 312 by keys that are inserted into corresponding keyholes or slots in the sides of the housings 310 and 312, and into outer circumferential grooves formed about the two thrust transmitting system 338*a*, 338*b*, or, retained to the shaft by thrust carrying disc 342 attached to the shaft and into inner circumferential grooves formed about the two thrust transmitting system 338*a*, 338*b*, or, the two thrust transmitting system 338*a*, 338*b* can be attached free. This construction allows the working sleeve 314 to rotate freely relative to the shaft 302, or considered in another manner, the shaft 302 may rotate freely within the sleeve 314. This also may allow the two springs 334, 336 to work together to create a spring assembly of equivalent stiffness equal to the combined stiffness of the individual springs depending on the spring sets attachment technique. Alternatively, spring sets 334 and 336 can be replaced with disc springs installed concentrically about shaft 302 and within the first and second housings 310 and 312 to bear against the first and second ends 316 and 320, respectively, of the working sleeve 314. In this configuration, the disc springs are working independently of each other and each is rated to the full required spring stiffness needed to control the axial position and clutching of working sleeve 314.

Each housing 310, 312 has a sleeve engagement end 350*a* and 350*b*, the two ends 350*a*, 350*b* facing one another. The working sleeve 314 has first and second housing engagement ends 352*a* and 352*b*, disposed about the respective opposite first and second end portions 316 and 320 of the sleeve. The sleeve engagement end 350*a* of the first housing 310 and the adjacent housing engagement end 352*a* of the first end portion 316 of the working sleeve 314 collectively comprise a first clutch mechanism. Similarly, the sleeve engagement end 350*b* of the second housing 312 and the adjacent housing engagement end 352*b* of the second end portion 320 of the working sleeve 314 collectively comprise a second clutch mechanism. In the case of the third embodiment tool 300 of FIGS. 9 through 11*b*, the first and second clutch mechanisms comprise first and second dog clutches, i.e., mechanisms that lock up abruptly to apply full drill string torque to the working sleeve due to sudden solid contact between mating teeth or other protrusions.

Figure 11A:
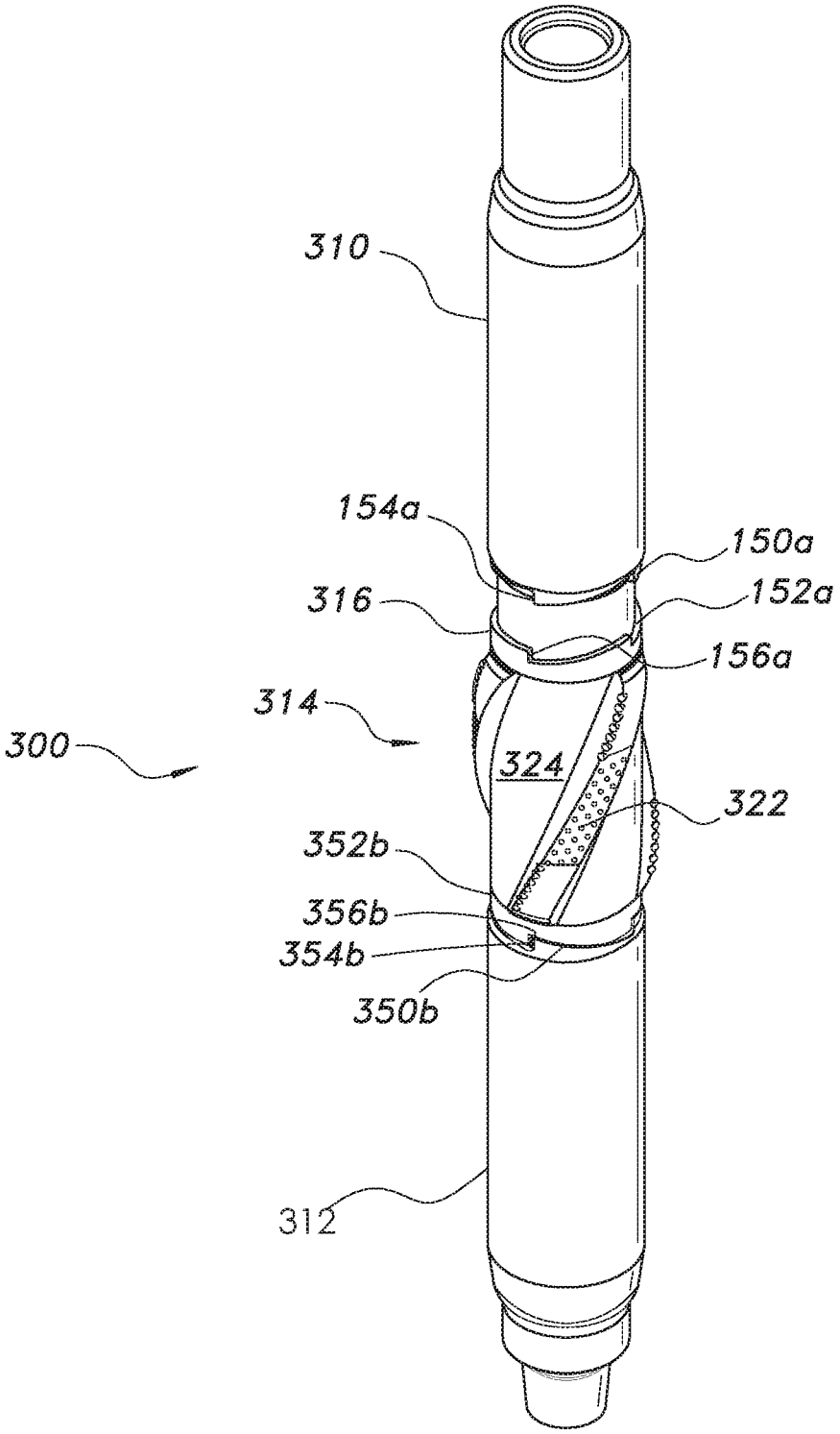
FIG. 11A is a perspective view of the assembled multifunction wellbore conditioning tool of FIG. 9, showing a working sleeve shifted axially toward the lower end of the assembly to engage rotationally with the lower portion of the tool.
Figure 11B:
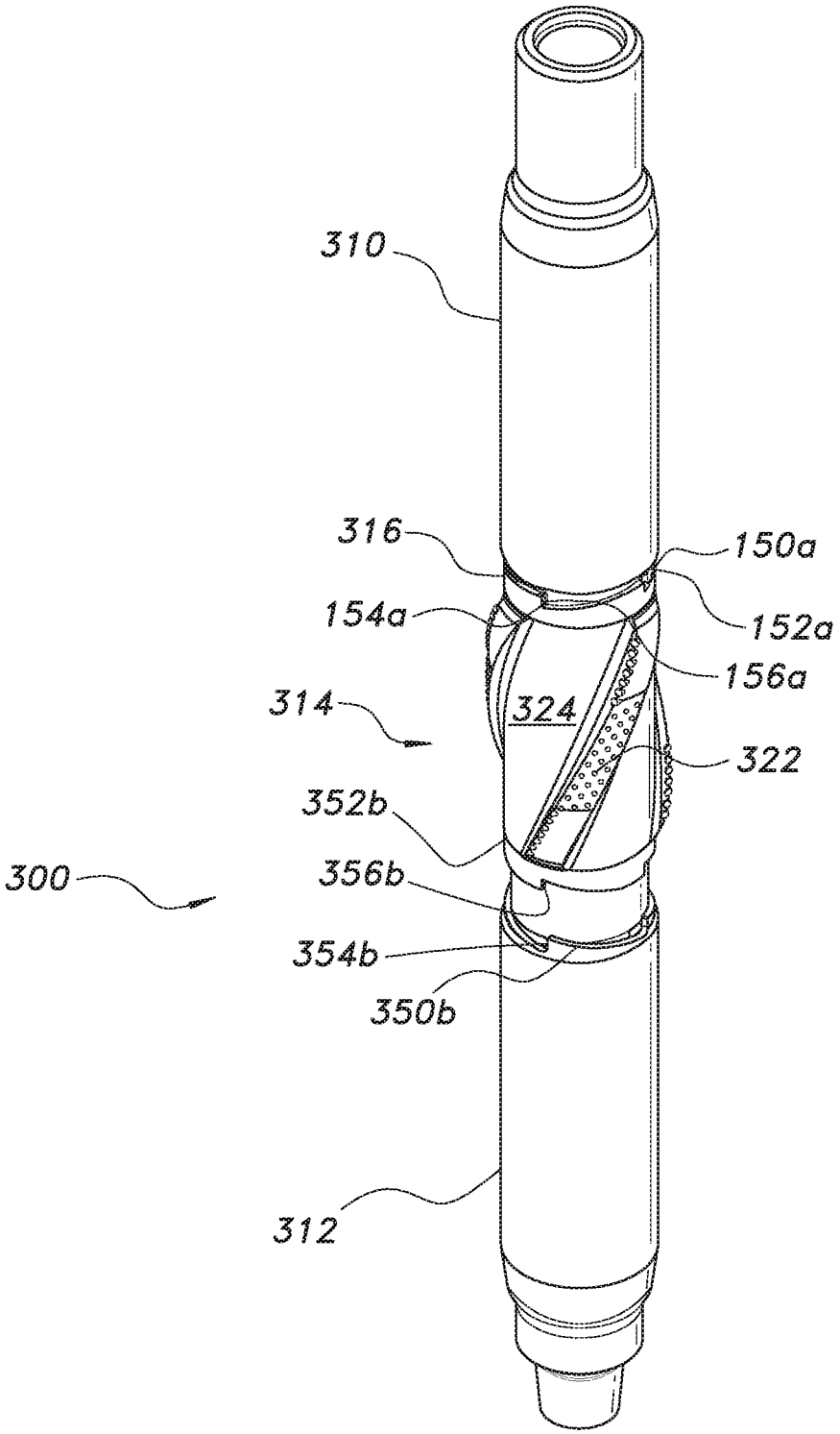
FIG. 11B is a perspective view of the assembled multifunction wellbore conditioning tool of FIG. 9, showing the working sleeve shifted axially toward the upper end of the assembly to engage rotationally with the upper portion of the tool.

The first dog clutch mechanism of the tool 300 comprises a first pair of axially oriented teeth or faces 354*a* (one such tooth being shown in FIGS. 9 through 11B) on the sleeve engagement end 350*a* of the first housing 310, which selectively engage corresponding teeth or faces 356*a* extending from the sleeve engagement end 352*a* of the first end portion 316 of the sleeve 314. The teeth 354*a* of the first housing 310 are circumferentially distributed and separated by protruded ramps. Similarly, the teeth 356*a* of the first end portion 316 of the sleeve 314 are circumferentially distributed and have spiral ramps extending therebetween. This construction causes the first dog clutch to lock up, i.e., to cause the working sleeve 314 to rotate in unison with the housing 310 (and thus the shaft 302) when the shaft 302 and housing 310 are rotating in a clockwise direction when viewed from above, as shown in FIG. 11*b*. However, the ramp configuration between the teeth allows the dog clutch mechanism to slip when the housing 310 rotates counterclockwise relative to the sleeve 314. Thus, if the working sleeve 314 encounters axial resistance sufficient to override the compression of the first spring 334 and the tensile force of the second spring 336, or the corresponding stack of disc springs used instead, and force the two components of the first dog clutch into engagement with one another, the sleeve 314 will be forced into rotation in unison with the shaft 302 and housing 310 by engagement of the first dog clutch mechanism, thereby reaming or otherwise conditioning the borehole by application of the full drill string torque to the working sleeve 314 as drilling continues.

In the event that the working sleeve 314 "hangs up" or is caught on some protrusion as the drill string (and thus the shaft 302) is withdrawn from the borehole, the shaft 302 will be drawn upward through the sleeve 314. If sufficient tensile force is applied to the sleeve 314, it will cause the second spring 336 to compress and the first spring 334 to extend to the extent that the two sets of dog clutch teeth 354*b* and 356*b* of the second end of the assembly will engage. This engagement of the first clutch assembly or mechanism is illustrated in FIG. 11*a* of the drawings. It will be noted that this engagement will only occur if the shaft 302 (and the second housing 312 immovably affixed thereto) is rotating in a clockwise direction when viewed from above. Rotation of the shaft 302 and housing 312 in the opposite direction will allow the sloped or ramp surfaces to slide relative to one another, without rotary engagement of the working sleeve 314. It will be seen that the orientation of the sloped surfaces between each of the axial teeth 354*a*, 356*a* and 354*b*, 356*b* may be reversed for drill strings that rotate in a counterclockwise direction. Also, more than two such teeth may be formed on the ends of the two housings 310, 312 and the facing ends of the central working sleeve 314, if desired. This will result in more rapid lockup of the sleeve 314 with either of the ends 310 or 312.

It is to be understood that the multifunction wellbore conditioning tool is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A multifunction wellbore conditioning tool, comprising:

an elongate, rigid shaft having a first end portion, a central portion, and a second end portion opposite the first end portion, the shaft being adapted for attachment to a drill string;

a substantially cylindrical first housing rotationally affixed axially and concentrically to the first end portion of the shaft;

a substantially cylindrical second housing rotationally affixed axially and concentrically to the second end portion of the shaft;

a working sleeve slidable axially and rotationally disposed concentrically upon the central portion of the shaft between the first housing and the second housing, the working sleeve having a first end portion, a central portion, and a second end portion opposite the first end portion, each of the end portions of the working sleeve having a plurality of passages disposed therethrough;

a first intermediate cylinder disposed concentrically between the first end portion of the shaft and the first end portion of the working sleeve, the first intermediate cylinder and the first end portion of the working sleeve defining a first annular volume therebetween;

a second intermediate cylinder disposed concentrically between the second end portion of the shaft and the second end portion of the working sleeve, the second intermediate cylinder and the second end portion of the working sleeve defining a second annular volume therebetween;

a plurality of teeth extending radially outward from the first intermediate cylinder and from the second intermediate cylinder into the respective first and second annular volumes, respectively; and a lug rotationally disposed in each of the passages of the working sleeve, each lug having a generally rectangular tooth engagement portion extending into one of the annular volumes, the tooth engagement portions of the lugs selectively engaging corresponding teeth of the first and second intermediate cylinders when the working sleeve slides about the shaft.

2. The multifunction wellbore conditioning tool as recited in claim 1, wherein the working sleeve has an external surface having a plurality of cutting elements disposed thereon, the working sleeve and the cutting elements defining a combination cutter, reamer, keyseat wiper, and stabilizer.

3. The multifunction wellbore conditioning tool as recited in claim 2, wherein the plurality of cutting elements are helically configured, being separated by helical flutes.

4. The multifunction wellbore conditioning tool as recited in claim 1, wherein said first housing has a first spring seat disposed therein and said second housing has a second spring seat disposed therein, the tool further comprising first and second spring sets concentrically mounted about the first and second end portions, respectively, of the elongate, rigid shaft, the first and second spring sets being disposed within the first and second housings and seated in the first and second spring seats, respectively, and having a thrust washer attached thereto bearing against the first and second end portions of the working sleeve, the springs biasing the working sleeve to a neutral position between the first and second housings and permitting the shaft to rotate freely inside working sleeve.

5. The multifunction wellbore conditioning tool as recited in claim 4, wherein the first housing and the second housing each have a plurality of key slots and the first and second spring seats each have circumferential grooves defined therein, the tool further comprising a key disposed in each of the key slots, the keys engaging the circumferential grooves in the corresponding spring seats and retaining the spring seats within the respective housing.

6. A multifunction wellbore conditioning tool, comprising:

an elongate, rigid shaft having a first end portion, a central portion, and a second end portion opposite the first end portion, the shaft being adapted for attachment to a drill string;

a substantially cylindrical first housing rotationally affixed axially and concentrically to the first end portion of the shaft;

a substantially cylindrical second housing rotationally affixed axially and concentrically to the second end portion of the shaft;

a working sleeve slidable axially and rotationally disposed concentrically upon the central portion of the shaft between the first housing and the second housing, the working sleeve having a first end portion, a central portion, and a second end portion opposite the first end portion;

a first clutch mechanism disposed on the first housing at the first end portion of the shaft and on the first end portion of the working sleeve;

a second clutch mechanism disposed on the second housing at the second end portion of the shaft and on the second end portion of the working sleeve;

a bearing assembly disposed between the shaft and the working sleeve;

a friction coupling sleeve disposed on the shaft between the shaft and the working sleeve;

first and second spring sets;

a first thrust transmitting system attached to a first end of the first spring set;

a second thrust transmitting system attached to a first end of the second spring set;

a first spring seat attached to a second end of the first spring set, and being further attached to the working sleeve at first end portion thereof; and a second spring seat attached to a second end of the second spring set, and being further attached to the working sleeve at the second end portion thereof.

7. The multifunction wellbore conditioning tool as recited in claim 6, wherein the working sleeve has an external surface having a plurality of cutting elements disposed thereon, the working sleeve and the cutting elements defining a combination cutter, reamer, keyseat wiper and stabilizer.

8. The multifunction wellbore conditioning tool as recited in claim 7, wherein the plurality of cutting elements are helically configured, being separated by helical flutes.

9. The multifunction wellbore conditioning tool as recited in claim 6, wherein the central portion of said shaft comprises a bearing system and a friction coupling sleeve.

10. The multifunction wellbore conditioning tool as recited in claim 6, wherein said first housing has the first spring seat disposed therein and said second housing has the second spring seat disposed therein, the first and second spring sets being concentrically mounted about the first and second end portions, respectively, of the elongate, rigid shaft, the first and second spring sets being respectively disposed within the first and second housings and seated in the first and second spring seats, respectively, and attached thereto against the first and second end portions of the working sleeve, the first and second spring sets biasing the working sleeve to a neutral position between the first and second housings and permitting the shaft to rotate freely inside the working sleeve.

11. The multifunction wellbore conditioning tool as recited in claim 6, wherein said first and second housings each have a sleeve engagement end, and the working sleeve has a first housing engagement end disposed about the first end portion thereof and a second housing engagement end disposed about the second end portion thereof, such that the sleeve engagement end of the first housing and the first housing engagement end of the working sleeve comprise a first dog clutch, and the sleeve engagement end of said second housing and the second housing engagement end of the working sleeve comprise a second dog clutch.

12. The multifunction wellbore conditioning tool as recited in claim 11, further comprising a friction coupling sleeve.

13. The multifunction wellbore conditioning tool as recited in claim 6, wherein said first mechanical coupling mechanism comprises circumferentially-distributed teeth defined in the first housing, the housing teeth being connected by protruding ramps, and corresponding sleeve teeth being defined in the first end portion of the working sleeve, the sleeve teeth being connected by protruding ramps, the housing ramps and the sleeve ramps rotating in opposite directions, said second clutch mechanism comprising circumferentially-distributed teeth defined in the second housing, the housing teeth being connected by protruding ramps, and corresponding sleeve teeth being defined in the second end portion of the working sleeve, the sleeve teeth being connected by protruding ramps, the housing ramps and the sleeve ramps rotating in opposite directions.

14. The multifunction wellbore conditioning tool as recited in claim 13, further comprising first and second friction coupling sleeves.

* * * * *